US005253766A

United States Patent [19]

Sims

[11] Patent Number: 5,253,766

[45] Date of Patent: Oct. 19, 1993

[54] WASTE DISPOSAL CHUTE

[76] Inventor: Geoffrey B. Sims, 429 Clendenan Ave., Toronto, Ontario, Canada, M6P 2X7

[21] Appl. No.: 669,500

[22] Filed: Mar. 14, 1991

[30] Foreign Application Priority Data

Apr. 5, 1990 [CA] Canada ..... 2013984

[51] Int. Cl.[5] ..... B07C 7/04

[52] U.S. Cl. ..... 209/702; 209/930; 193/2 A

[58] Field of Search ..... 209/702, 930, 655, 703, 209/924; 193/34, 2 A, 2 R; 232/44, 43.1, 43.2

[56] References Cited

U.S. PATENT DOCUMENTS

| | | | |
|---|---|---|---|
| 1,020,696 | 3/1912 | Hill | 193/2 A |
| 1,021,404 | 3/1912 | Gardner | 193/34 |
| 1,510,288 | 9/1924 | Malone | 193/34 |
| 1,975,533 | 10/1934 | Beaver | 193/34 |
| 2,038,659 | 4/1936 | Koran | 193/34 |
| 2,802,434 | 8/1957 | Dowse | 193/34 |
| 4,013,551 | 3/1977 | deFeudis | 209/606 |
| 4,640,403 | 2/1987 | McDermott | 232/44 X |
| 4,987,988 | 1/1991 | Messina et al. | 209/655 X |
| 5,031,829 | 7/1991 | Shantzis | 209/706 X |
| 5,083,704 | 1/1992 | Rounthwaite | 232/44 |

FOREIGN PATENT DOCUMENTS

| | | | |
|---|---|---|---|
| 2576348 | 7/1986 | France | 193/34 |
| 388182 | 9/1976 | Sweden | 209/655 |

*Primary Examiner*—David H. Bollinger
*Attorney, Agent, or Firm*—Krass & Young

[57] ABSTRACT

A waste disposal chute assembly is disclosed for segregating waste material in a multi-story building. The chute assembly has a plurality of laterally adjacent chutes, which may be nested together. Each chute has a plurality of elongate, longitudinal, telescoping members. The telescoping members have an inlet port, an outlet port and a telescoping portion. Seam cleats are provided to facilitate the unobstructed telescoping of the telescoping members into those below. Laterally adjacent telescoping members are attached and each chute has an opening to provide access thereto. Each opening may be covered by a door which is adapted to provide access to more than one opening. The chute assembly is retained in the multi-story structure.

11 Claims, 5 Drawing Sheets

WASTE DISPOSAL CHUTE

FIELD OF THE INVENTION

This invention relates to a chute assembly for use in a multi-story building and more specifically, to a waste disposal chute assembly for segregating waste material.

BACKGROUND OF THE INVENTION

In order to facilitate an apartment dweller in recycling its waste, an easy to use system is needed. As well, in a hospital setting it is desirable to segregate contaminated waste from other waste, so that the contaminated waste can be treated properly. To segregate mixed waste, separate chutes can be provided. However, in general, in existing buildings there is only a limited area that is designated for waste disposal and that is usually already fitted with a single chute. Adding additional chutes of large enough size to be useful, therefore, would not be possible. In buildings to be constructed it is desirable to use as small an area as possible so as to maximize the usable space, so multiple conventional chutes are undesirable because this would take up too much space.

One example of a waste disposal system for segregating material without taking up an undesirable amount of space is shown in U.S. Pat. No. 4,013,551 issued on Mar. 22, 1977 to S. de Feudis. This patent shows a system for sorting goods having a plurality of storage spaces feeding into a common chute. Each storage space has a locking mechanism which when released discharges the material into the chute. Switching valves are located in the chute for distributing the various types of materials into corresponding containers. A particular disadvantage of this prior art system is that a common chute is used to channel the material to the various containers thereby risking the contamination of the non-contaminated materials.

SUMMARY OF THE INVENTION

The present invention seeks to provide a chute assembly having a plurality of chutes which can be installed in a confined space and which segregates material.

According to one aspect of the invention, there is provided a chute assembly for segregating material in a multi-story structure. The chute assembly has a plurality of laterally adjacent chutes. Each chute has a plurality of elongate longitudinal telescoping members. The telescoping members have an inlet port, an outlet port and a telescoping portion. The chute assembly has means for providing access to each chute. The chute assembly has means for retaining the chutes in the multi-story building. The telescoping portions and the outlet ports are formed at the same end of each telescoping member so that each outlet port fits snugly inside the inlet port of the longitudinally adjacent telescoping member below. A first vertical companion clip is attached to one of the telescoping members. A second vertical companion clip is attached to another telescoping member laterally adjacent to the first. The first vertical companion clip is releasably connected to the second vertical companion clip.

According to another broad aspect of the invention, there is provided a chute assembly for segregating material in a multi-story structure. The chute assembly has a plurality of laterally adjacent chutes nested together. Each chute has a plurality of elongate longitudinal telescoping members. The telescoping members have an inlet port, an outlet port and a telescoping portion. The chute assembly has means for attaching laterally adjacent telescoping members, the attaching means being spaced from the telescoping portion, and means for providing access to each chute. The chute assembly has means for retaining the chutes in the multi-story building. One of the chutes is generally mushroom shaped in cross-section and has a narrow access portion and a larger transport portion.

According to another broad aspect of the invention, there is provided a chute assembly for segregating material in a multi-story structure. The chute assembly has a plurality of laterally adjacent chutes. Each chute has a plurality of elongate, longitudinal, telescoping members. The telescoping members have an inlet port, an outlet port and a telescoping portion. The chute assembly has means for attaching laterally adjacent telescoping members, the attaching means being spaced from the telescoping portion, and means for providing access to each chute. The chute assembly also has means for retaining the chutes in the multi-story building. The telescoping members are grouped into intermediate sections having elongate, longitudinal portions and intake sections having access openings and means for removably covering said access openings. The covering means includes doors hingeably attached to the intake sections, each of which doors covers access openings of at least two of the chutes.

According to another broad aspect of the invention, there is provided a chute assembly for segregating material in a multi-story structure. The chute assembly has plurality of laterally adjacent chutes. Each chute has a plurality of elongate, longitudinal telescoping members. The telescoping members have an inlet port, an outlet port and telescoping portion. The chute assembly has means for attaching laterally adjacent telescoping members, the attaching means being spaced from telescoping portion, and means for providing access to each chute. The chute assembly has means for retaining the chutes in a multi-story building. The chute assembly also includes a plurality of seam cleats attached to at least two of the laterally adjacent telescoping members at their inlet ports to hold top edges of the laterally adjacent telescoping members together.

The invention is illustrated in particular and preferred embodiments by reference to the accompanying drawings.

DETAILED DESCRIPTION OF AN ILLUSTRATIVE EMBODIMENT

Figure 1:
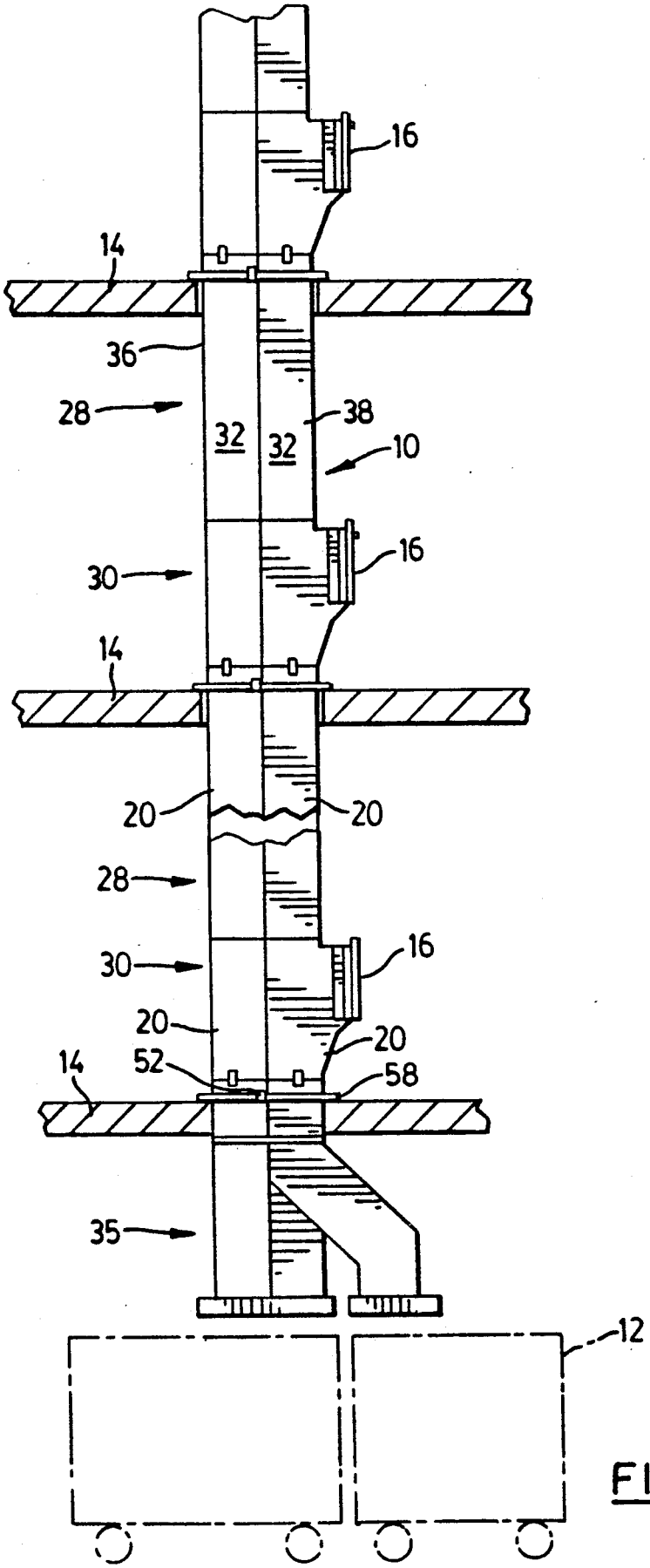
FIG. 1 is a side view of a preferred embodiment of a chute assembly located in a multi-story structure.

The chute assembly 10 shown in FIG. 1 is adapted to direct material to separate bins 12 at the bottom of a multi-story building or structure. There are three chutes, 36, 38 and 40 respectively. The largest chute 36 is generally mushroom shaped in cross-section, and can be used for general waste. The smaller chutes 38 and 40 fit into the mushroom shaped chute 36 and are generally rectangular in cross-section. The rectangular chutes 38 and 40 can be for glass and paper respectively, however, any of the chutes 36, 38 and 40 can be used for any particular material which is desired to be separated or segregated from the rest of the waste. Chute assembly 10 includes a means for retaining the chute assembly 10 in each floor 14 as will be described further below. Spaced above each floor 14 is an access means 16 for the chute assembly 10.

Figure 2:
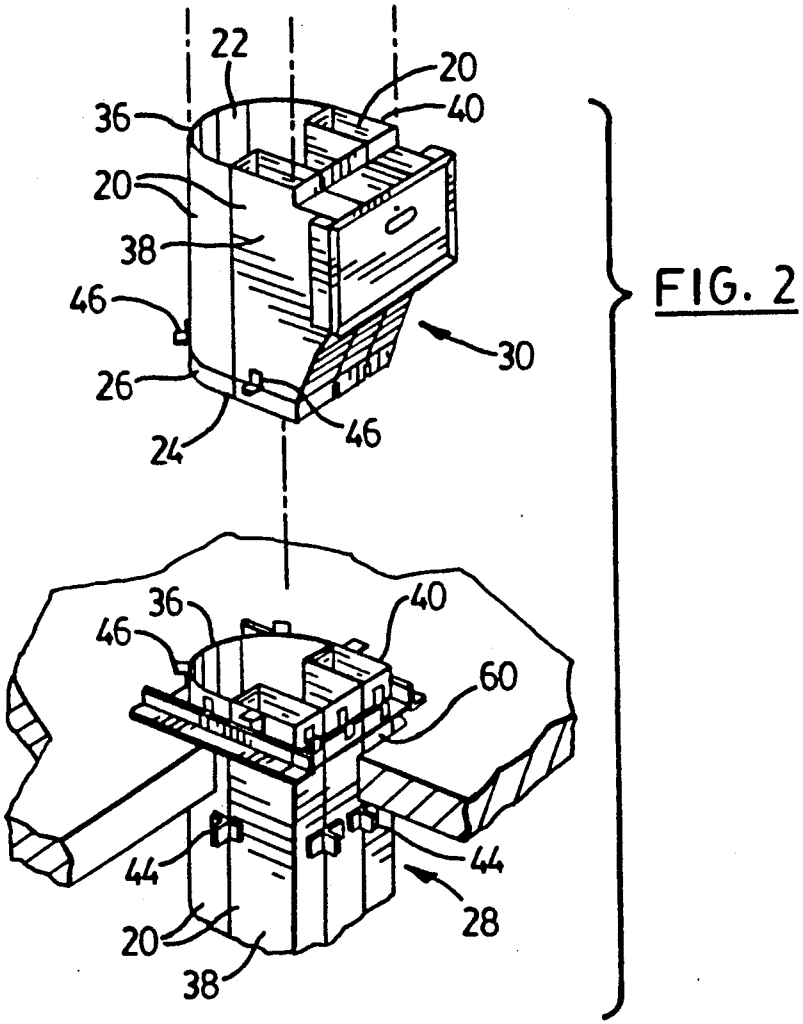
FIG. 2 is an exploded view of a portion of the chute assembly shown in FIG. 1.
Figure 6:
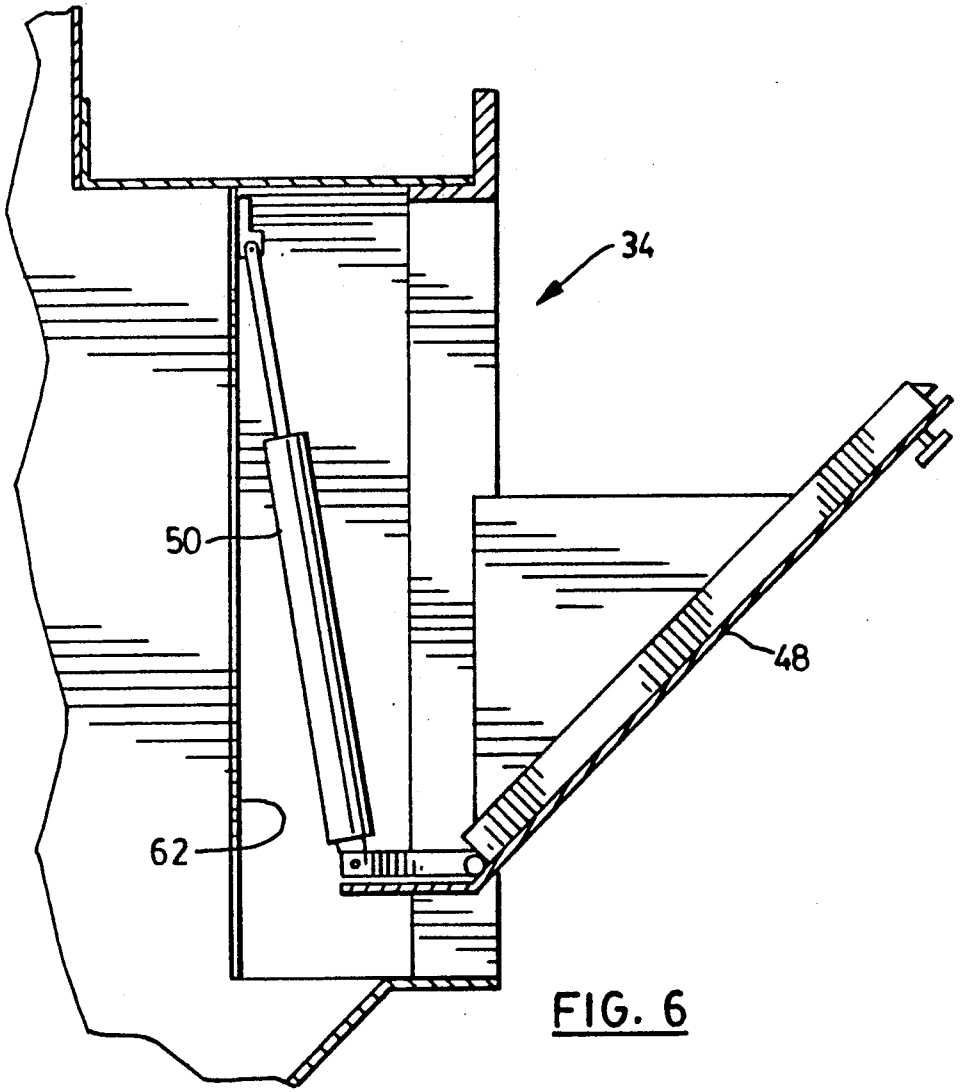
FIG. 6 is a side view of the chute assembly as taken along lines 6—6 of FIG. 5.

As mentioned above, the chute assembly 10 is made up of a plurality of laterally adjacent chutes 36, 38 and 40. Each such chute has a plurality of elongate, longitudinal, telescoping members 20. Each telescoping member 20 has an inlet port 22 and an outlet port 24 and a tapered or telescoping portion 26. As shown in FIG. 2, the telescoping portions 26 and the outlet ports 24 are at the same end of telescoping members 20. As seen best in FIG. 2, telescoping members 20 are grouped into telescoping sections 28 and 30 containing equal length telescoping members 20. There are two main types of telescoping sections, namely, intermediate telescoping sections 28 (see FIG. 1), and intake telescoping sections 30. Each intermediate section 28 has an elongate longitudinal portion 32 which extends from its top inlet port 22 to the inlet port 22 of the intake section 30 located below it.

Each intake section 30 has a front access opening 34 (see FIG. 5) to allow waste material to be inserted into chutes 36, 38 and 40. A door 48 is hingeably attached to intake section 30 below front opening 34 to provide a means to selectively cover access opening 34. Door 48 may be mounted on supporting means, such as frame 62, attached to said chutes 36, 38 and 40 at front opening 34. A hydraulic closing mechanism 50 is connected to door 48 to automatically close the door. Refuse separation guides 60 are attached to each door 48 in order to help prevent waste intended for one of chutes 36, 38 or 40 from accidentally spilling into another.

Figure 4:
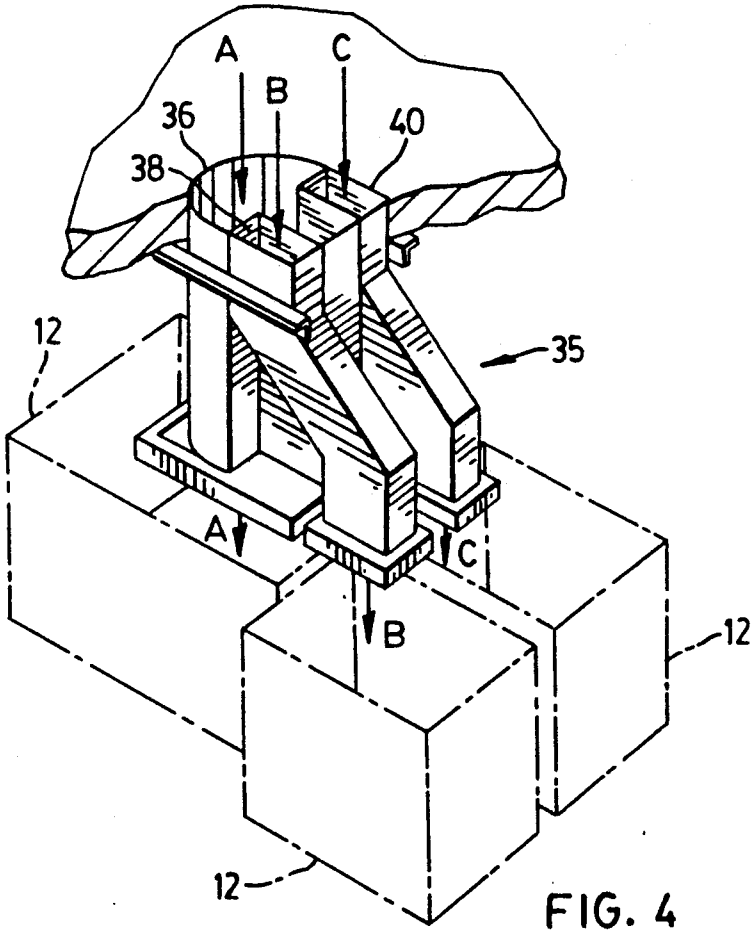
FIG. 4 is a perspective view of the bottom portion of the chute assembly.

Below the lowermost floor 14 as seen in FIG. 1, a modified bottom telescoping section 35 is provided where the chutes 36, 38 and 40 are directed such that the material in the chutes is dumped into separate bins 12 as shown in FIGS. 1 and 4. Bottom telescoping section 35 could be located in the basement of a building or at any floor where the output of chute assembly 10 is desired. In fact, chute assembly 10 could be mounted adjacent to an exterior wall with bottom section 35 directing the waste to the exterior of the building.

Figure 3:
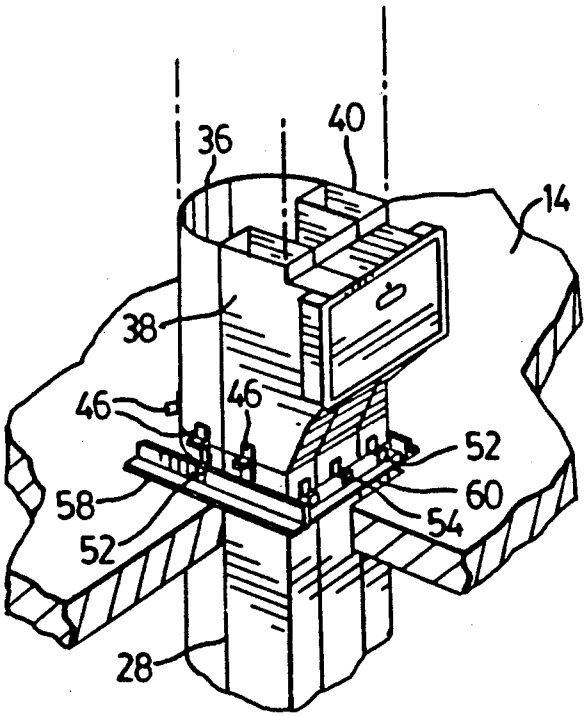
FIG. 3 is a perspective view of the assembled portion of the chute assembly shown in FIG. 2.
Figure 5:
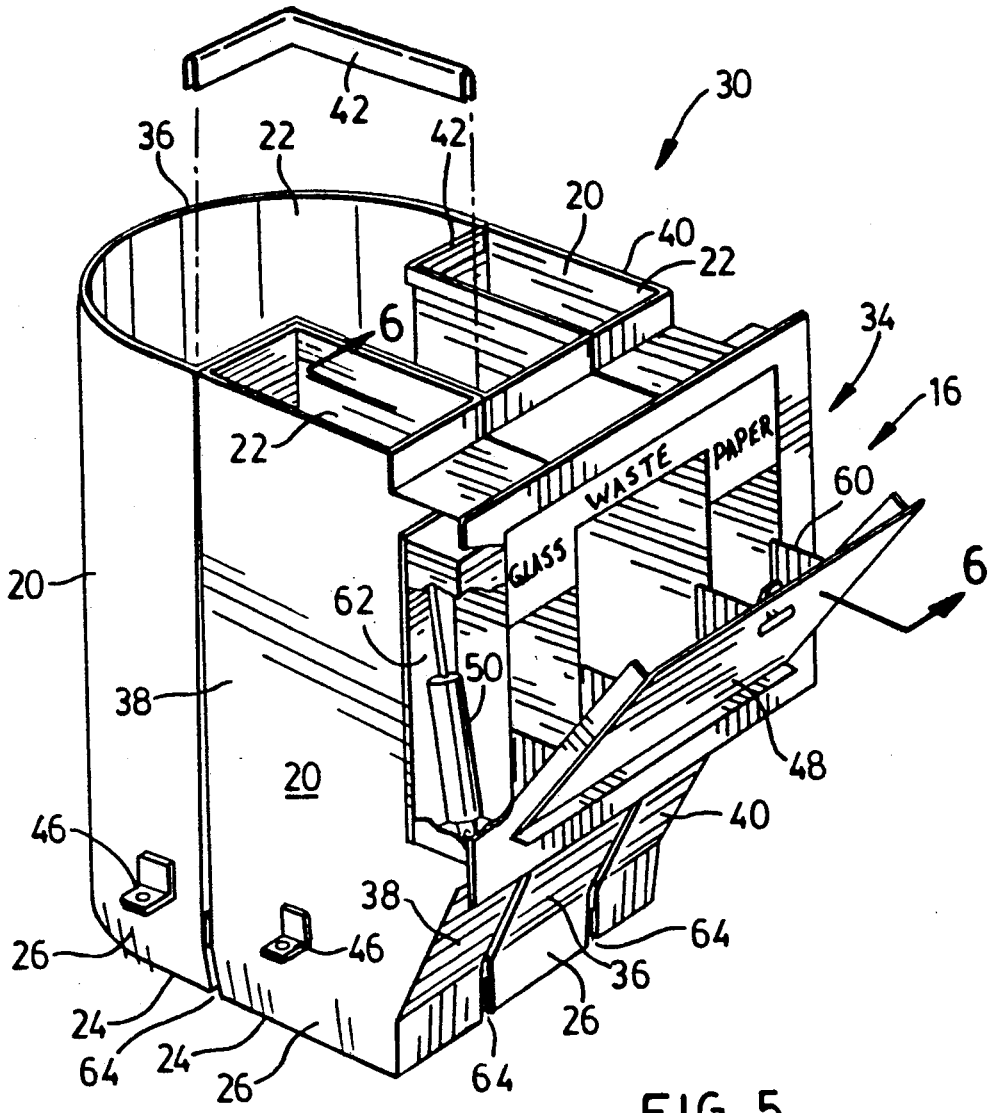
FIG. 5 is a perspective view of an inlet or access portion of the chute assembly.
Figure 7:
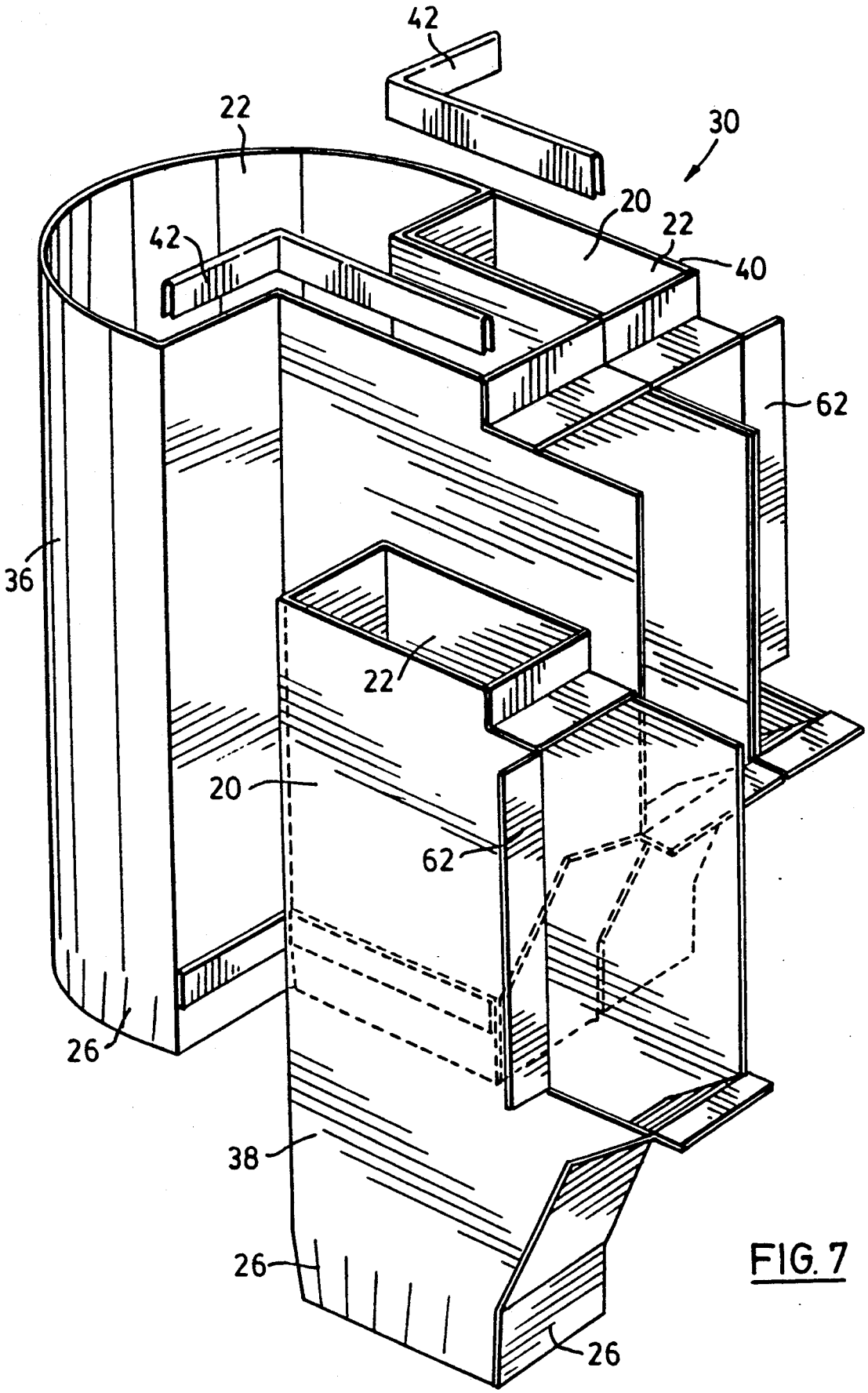
FIG. 7 is a partially exploded perspective view of an inlet or access portion of the chute assembly.

The tops of the telescoping members 20 of the chutes 36, 38 and 40, which form intake sections 30 are attached by horizontal seam cleats 42 (see FIG. 5). The sides of laterally adjacent intermediate sections 28 are attached by vertical angle brackets or companion clips 44 (see FIG. 2). Intermediate sections 28 are attached to longitudinally adjacent intake sections 30 by horizontal angle brackets or companion clips 46 (see FIGS. 3 and 5), using conventional threaded fasteners (not shown).

To attach an intermediate section 28 to a floor 14, there are provided S-shaped protrusions or brackets 52 (see FIG. 3), which have downwardly extending clips or flanges 54 that hook over angle irons 58. Angle irons 58 have a portion or flange extending upwardly from the floor and are positioned adjacent to the associated intermediate section 28. Angle irons 58 are located around the peripheries of openings 60 in floors 14 which accommodate chute assembly 10.

To install the chute assembly 10, the angle irons 58 are installed around openings 60 in floor 14. The bottom section 35 is installed in the lowermost floor 14. The first or lowermost intake section 30 is assembled by attaching horizontal seam cleats 42 to the upper peripheral adjacent edges of the telescoping members 20 making up intake section 30. The lower telescoping portions 26 of the the intake section 30 are free and tapered away from each other to form gaps 64 into which seam cleats 42 fit so that they can fit snugly into the inlet ports 22 of the bottom section 35 located therebelow. The laterally adjacent telescoping members 20 of the intermediate sections 28 are then attached by the vertical companion clips 44, and the first or lowest intermediate section 28 is then lowered through aperture 60 in the second lowest floor 14, until the telescoping portions 26 fit into the inlet ports 22 of the intake section 30 therebelow and protrusions 52 engage or hook over the angles 58.

The next intake section 30 is then lowered into the intermediate section 28 below it, and the adjacent horizontal companion clips 46 on respective intake and intermediate sections 30, 28 are connected together, such as with threaded fasteners. The same procedure is repeated working from the ground floor up, such that the next intermediate section 28 extends through the floor above the last intake section 30. The top intake section (not shown) would then simply be closed off, although this is not essential.

Having described preferred embodiments of the invention, it will be appreciated that various modifications may be made to the structures described. For example, the various telescoping members could be connected together in other ways, such as by welding. Chutes 36, 38 and 40 could be other cross-sectional shapes. It is desirable, however, that they be nested is some fashion to conserve space. Multiple access doors could be used in place of door 48. Chutes 36, 38 and 40 could be made out of any suitable material, such as sheet metal, plastic or stainless steel. Finally, it is not necessary that there be intake sections on all floors of a building. Some floors could be bypassed by substituting intermediate sections for the normal intake sections.

From the above, it will be apparent that the waste disposal chute of the present invention is a very compact, simple to assemble multiple chute assembly, where the individual chutes are completely segregated.

What is claimed is:

1. A chute assembly, for segregating material in a multi-story structure comprising:

a plurality of laterally adjacent chutes, each chute having a plurality of elongate, longitudinal, telescoping members, said telescoping members each having an inlet port, an outlet port and a telescoping portion, said telescoping portions and said outlet ports being formed at the same end of each telescoping member, each of said outlet ports fitting snugly inside the inlet port of the longitudinally adjacent telescoping member below;

means for providing access to each chute;

means for retaining said chutes in the multi-story structure;

a first vertical companion clip attached to one of said telescoping members; and a second vertical companion clip attached to a laterally adjacent telescoping member, wherein said first vertical companion clip is releasably connected to said second vertical companion clip.

2. A chute assembly, for segregating material in a multi-story structure comprising:

a plurality of laterally adjacent chutes, each chute having a plurality of elongate, longitudinal, telescoping members, said telescoping members each having an inlet port, an outlet port and a telescoping portion, said telescoping portion and said outlet port being formed at the same end of each telescoping member, each outlet port fitting snugly inside the inlet port of the longitudinally adjacent telescoping member below;

means for attaching laterally adjacent telescoping members, said means being spaced from the telescoping portions;

means for providing access to each chute;

means for retaining said chutes in the multi-story structure;

said telescoping members being grouped into intermediate sections having elongate, longitudinal portions and intake sections, said intake sections having access openings, and means for removably covering said access openings, said covering means comprising doors hingeably attached to said intake sections, each of said doors covering access openings in at least two of said chutes.

3. A chute assembly as claimed in claim 2 and further comprising refuse separation guides attached to said doors.

4. A chute assembly, for segregating material in a multi-story structure comprising:

a plurality of laterally adjacent chutes, each chute having a plurality of elongate, longitudinal, telescoping members, each telescoping member having an inlet port, an outlet port and a telescoping portion;

means for attaching laterally adjacent telescoping members, said means being spaced from the telescoping portions;

means for providing access to each chute;

means for retaining said chutes in the multi-story structure; and a plurality of seam cleats attached to at least two of said laterally adjacent telescoping members at their inlet ports to hold top edges of the laterally adjacent telescoping members together.

5. A chute assembly for segregating material in a multi-story structure comprising:

a plurality of laterally adjacent chutes, each chute having a plurality of elongate, longitudinally, telescoping members and each telescoping member having an inlet part and an outlet port and a telescoping portion, said chutes being laterally nested together to form said chute assembly;

means for attaching laterally adjacent telescoping members, said means being spaced from the telescoping portions;

means for providing access to each chute; and means for retaining said chutes in the multi-story structure wherein one of said chutes is generally mushroom shaped, said mushroom shaped chute having a narrow access portion and a longer transport portion.

6. A chute assembly as claimed in claim 5 and further comprising two nested chutes, each of said nested chutes being laterally adjacent to said access portion and said transport portion.

7. A chute assembly as claimed in claim 6 wherein said telescoping portions and said outlet ports are formed at the same end of each telescoping member, and wherein said outlet port fits snugly inside the inlet port of the longitudinally adjacent telescoping member below.

8. A chute assembly as described in claim 6 wherein said telescoping members are grouped into elongate, longitudinal intermediate sections having elongate longitudinal portions, and intake sections having access openings, and further comprising means for selectively covering said access openings, said covering means comprising doors hingeably attached to said intake sections, each of said doors covering access openings in at least two of said chutes.

9. A chute assembly as claimed in claim 8 and further comprising refuse separation guides attached to said doors.

10. A chute assembly as claimed in claim 6 and further comprising a plurality of first vertical companion clips attached to said telescoping members and a plurality of second vertical companion clips attached to laterally adjacent telescoping members, wherein said first vertical companion clips are releasably connected to said second vertical companion clips.

11. A chute assembly as claimed in claim 6 and further comprising a plurality of seam cleats attached to at least two of said laterally adjacent telescoping members at their inlet ports to hold top edges of the laterally adjacent telescoping members together.

* * * * *